United States Patent [19]

Tsuchiya et al.

[11] Patent Number: 4,680,669

[45] Date of Patent: Jul. 14, 1987

[54] CORONA DISCHARGING APPARATUS

[75] Inventors: Hiroaki Tsuchiya; Kazuki Tanaka, both of Yokohama; Keishi Osawa, Kawasaki, all of Japan

[73] Assignee: Canon Kabushiki Kaisha, Tokyo, Japan

[21] Appl. No.: 573,341

[22] Filed: Jan. 24, 1984

[30] Foreign Application Priority Data

Jan. 25, 1983 [JP] Japan ..... 58-10244
Jan. 25, 1983 [JP] Japan ..... 58-10245
Jan. 25, 1983 [JP] Japan ..... 58-10246

[51] Int. Cl.[4] ..... H01T 23/00

[52] U.S. Cl. ..... 361/230; 361/235; 361/213; 361/229; 55/112; 250/234; 15/1.5 R

[58] Field of Search ..... 361/230, 229, 213, 235; 55/112; 15/1.5; 250/324, 325, 326; 310/323

[56] References Cited

U.S. PATENT DOCUMENTS

| | | | |
|---|---|---|---|
| 3,483,669 | 12/1969 | Glaeser et al. | 55/112 |
| 3,496,352 | 2/1970 | Jugle | 15/1.5 R |
| 3,945,613 | 3/1976 | Jysky et al. | 55/112 X |
| 3,953,772 | 4/1976 | Zimmer | 361/230 X |
| 3,978,380 | 8/1976 | Talmage | 250/324 X |
| 4,008,057 | 2/1977 | Gelfand et al. | 55/112 X |
| 4,130,852 | 12/1978 | Peffer et al. | 361/213 |
| 4,325,264 | 4/1982 | Sashida | 310/323 X |

*Primary Examiner*—Roy N. Envall, Jr.
*Assistant Examiner*—Derek S. Jennings
*Attorney, Agent, or Firm*—Fitzpatrick, Cella, Harper & Scinto

[57] ABSTRACT

A corona discharging apparatus is adapted to vibrate a corona discharge wire and/or grid wires by the use of a vibrating element to remove foreign matters deposited on the corona discharging wire and/or grid wires.

13 Claims, 17 Drawing Figures

CORONA DISCHARGING APPARATUS

BACKGROUND OF THE INVENTION

1. Field of the Invention

The present invention relates to a corona discharger suitable for use in charging or charge-removing of a surface to which the corona discharge is applied.

2. Description of the Prior Art

Known corona dischargers used in electrophotographic systems, electrostatic recording systems and so on include a corotron device comprising a corona discharging wire connected with a source of high voltage and a shielding plate surrounding the corona discharging wire and a scorotron device comprising the corotron device and a corona discharge current controlling member provided within the above corotron device, which member will be called a "grid". Each of these devices functions to create a corona discharge when a high voltage is applied to the corona discharge wire. This cannot avoid the dust collecting action due to the corona discharge such that the corona discharging wire, grid, shielding plate and other elements will be contaminated by foreign matters such as scattered developer particles, oxides produced under the corona discharge, dust in the air, powdered paper material and others. Particularly, the contaminated corona discharge wire and the grid tend to cause an irregular discharge so that a surface to which the corona discharge is applied will not uniformly be charge or charge-removed. Thus, an operator must periodically clean the corona discharge wire and the grid by using a cleaning member to maintain the desired function of corona discharge.

SUMMARY OF THE INVENTION

It is therefore an object of the present invention to provide a corona discharger which can maintain the desired stable function of corona discharge.

Another object of the present invention is to provide a corona discharger which can maintain the desired stable function of corona discharge through a prolonged time period without any cleaning member which periodically scrapes and cleans the corona discharge wire and grid.

Still another object of the present invention is to provide a corona discharger which is superior in durability.

In a particular aspect of the present invention, the above objects are accomplished by vibrating the corona discharge electrode and/or grid electrode of a corona discharger to shake any foreign matters off the corona discharge electrode and grid electrodes.

Other objects and features of the present invention will be apparent from reading the following detailed description in connection with the accompanying drawings.

DETAILED DESCRIPTION OF THE PREFERRED EMBODIMENTS

Figure 1:
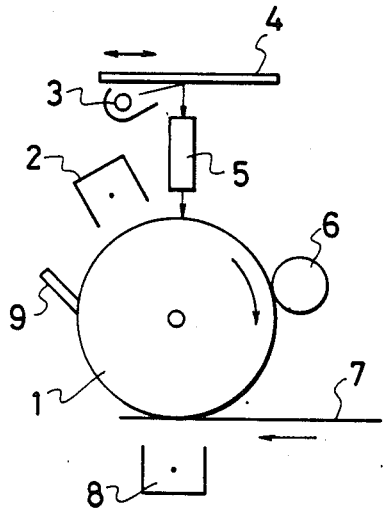
FIG. 1 is a schematic view of an electrophotographic type copying machine.

FIG. 1 is a schematic view showing only the outline of an electrophotographic type copying machine to which the corona discharger according to the present invention can be applied.

The copying machine comprises a photosensitive member 1 supported to rotate in the direction of the arrow. Around this photosensitive member 1 are disposed a charger 2 for uniformly charging the surface of the photosensitive member 1; an imaging element 5 for imaging the reflective light image of an original 4 on the photosensitive member surface to form a latent image, the original 4 being illuminated by a lamp 3 and at the same time moved in the direction of the arrow; a developing device 6 for visualizing the above latent image; a transfer charger 8 for transferring the visualized image from the photosensitive member to a transfer material 7 which has been fed in synchronism with the rotation of the photosensitive member 1; and a cleaner 9 for removing the residual developer on the photosensitive member 1, in the order mentioned above. After the transfer step, the above transfer material 7 is moved through a fixing device (not shown) whereat the image is fixed to the surface of the transfer material.

The corona discharger according to the present invention can be used, for example, as the charger 2 or transfer charger 8 mentioned above. Where the corona discharger of the present invention is applied to an electrophotographic system, it can be used as various chargers such as a pre-charger for removing charge, post-charger and the like in addition to said charger.

Figure 2:
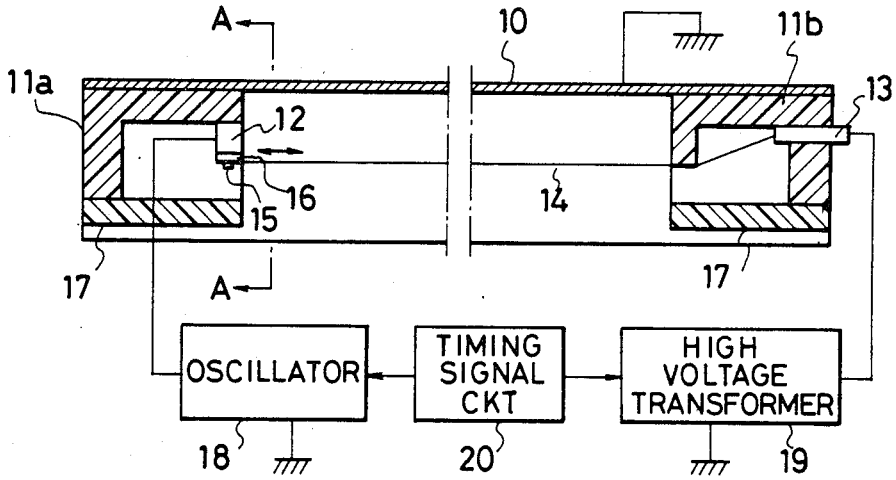
FIGS. 2 and 4 are longitudinal cross-sections of different embodiments of the present invention.
Figure 3:
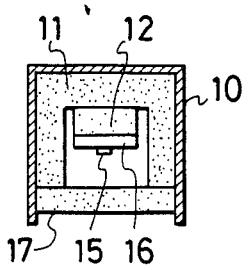
FIGS. 3 and 5 are transverse cross-sections taken along the respective lines A—A in FIGS. 2 and 4.

Referring to FIGS. 2 and 3, a corona discharger according to the present invention comprises a shield plate 10 of substantially U-shaped cross-section and insulation supports 11*a* and 11*b* mounted on the shield plate 10 at the opposite ends. A supersonic vibrator element 12 is mounted integrally on one of the insulation supports 11*a* while an external connector 13 is mounted integrally on the other insulation support 11*b*.

A corona discharge wire 14 is spanned between the insulation supports 11*a* and 11*b*. The corona discharge wire 14 is mounted at one end on the supersonic vibrator element 12 by an anchoring pin 15 with the other end thereof being attached to the connector 13.

Each of the insulation supports 11*a* and 11*b* has a bottom opening formed therein which is closed by a closure 17 of insulation resin material.

The corona discharger shown also comprises an oscillator circuit 18 connected with the supersonic vibrator element 12, a high-voltage transformer 19 connected with the connector 13, and a timing signal circuit 20 for controlling the oscillator circuit 18 and the high-voltage transformer 19.

The supersonic vibrator element 12 may be made of one selected from the group consisting of barium titanate, lead zironate titanate (PZY), mixture of lead-lantharum and zirconium-titanium oxide (PLZT) and other organic materials which can perform the piezo-electric effect. The configuration of the vibrator element may be of a single plate or a lamination consisting of two or more plates.

The oscillator circuit 18 may be of any suitable type as far as it can apply an electric alternating field or another similar electric field to the supersonic vibrator element 12. Although the supersonic vibrator element 12 may be vibrated in the direction of the arrow, that is, parallel to the length of the corona discharge wire, the direction of vibration is not limited to this particular direction and may be perpendicular or slant to the corona discharge wire 14. It is however preferred that the supersonic vibrator element is vibrated parallel to the length of the corona discharge wire because the spacing between the corona discharge wire and a surface to which the corona discharge is applied can be maintained substantially constant so that the corona discharge wire will be prevented from being damaged, while at the same time an irregular discharge due to the variations of the distance between the corona discharge wire and the above surface may be relieved. The amplitude of the corona discharge wire 14 is equal to about several microns with the frequency thereof being preferably of several tens KHz. However, this frequency is not limited to the above value and may be effective in the range from several kilohertzes to several megahertzes.

Figure 4:
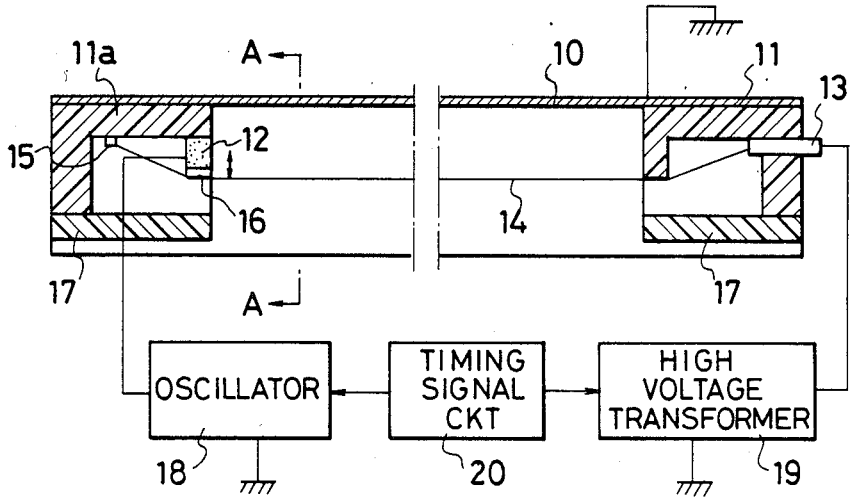
Figure 5:
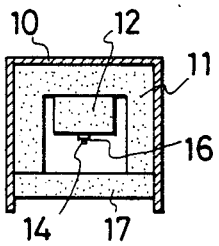
Figure 6:
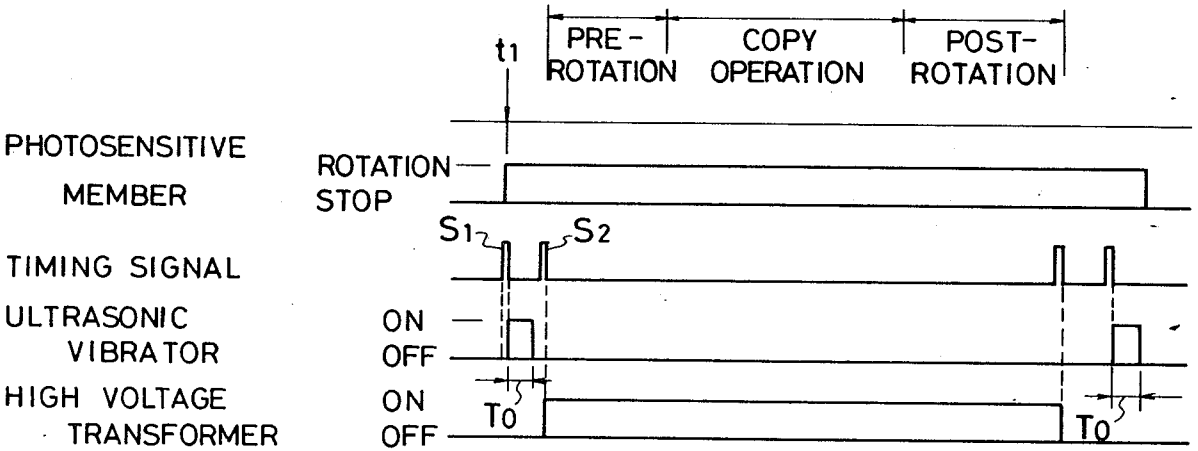
FIG. 6 is a timing diagram illustrating the operation of a supersonic vibrator.

In another embodiment of the present invention shown in FIGS. 4 and 5, the corona discharge wire 14 is spanned between the insulation supports 11*a* and 11*b* by attaching one end of the corona discharge wire 14 to the insulation support 11*a* rather than the supersonic vibrator element 12 by the anchoring pin 15 and pressing the corona discharge wire 14 against the supersonic vibrator element 12 through an insulation member 16.

Where the corona discharger as shown in FIG. 2 or 4 is applied to such an electrophotographic type copying machine as shown in FIG. 1, that corona discharger operates as shown in FIG. 6, for example.

If a copy signal is supplied to the corona discharger by depressing a copy button (not shown) as shown at a point $t_1$ in FIG. 6, the photosensitive member 1 is initiated to rotate while at the same time the timing signal circuit 20 generates a timing signal $S_1$ which is in turn supplied to the oscillator circuit 18. Thus, the oscillator circuit 18 is operated for a few or several seconds as shown at $T_0$ in FIG. 6. The output of the oscillator circuit 18 is then supplied to the supersonic vibrator element 12. The supersonic vibrator element 12 then vibrates under the piezoelectric effect to vibrate the corona discharge wire 14 in the direction of the arrow as shown in FIG. 2 or 4. As a result, foreign matters such as developer, oxides, dust, powdered paper material and others may be shaken off the corona discharge wire 14. Thereafter, the timing signal circuit 20 generates a subsequent timing signal $S_2$ which is in turn supplied to the high-voltage transformer 19 to generate a high-voltage output. This high-voltage output is applied to the corona discharge wire 14 through the connector 13. Thus, the corona discharge wire 14 provides a corona discharge which uniformly charges the surface of the rotating photosensitive member 1. The photosensitive member 1 is first rotated through pre-rotation or preliminary smoothing rotation and then enters a copy rotation through which a copy operation is made. Thereafter, the photosensitive member 1 is rotated through a post-rotation or a subsequent smoothing rotation. Upon completion of the post-rotation, the high-voltage transformer is turned off.

After a few seconds, the oscillator circuit 18 generates a further timing signal which is in turn supplied to vibrator the vibrate element for a few seconds. Thus, the corona discharge wire is vibrated to shake foreign matters thereoff. The vibration of the corona discharge wire 14 may be made during either of the pre-rotation, post-rotation or copy rotation of the photosensitive member 1. Even if the corona discharge wire 14 is vibrated as a high voltage is applied thereto, the vibration will have less affect on the discharge or other operations so that the supersonic vibrator element may be actuated substantially at any desired time. There is, however, a danger that the formation of image will adversely be affected by the foreign matters separated from the corona discharge wire 14 as it is being vibrated. It is therefore preferred that the corona discharge wire is vibrated when no high voltage is applied thereto. This also provides such an advantage that the corona discharge wire can be operated always in its clean state when a high voltage is applied thereto.

Figure 7:
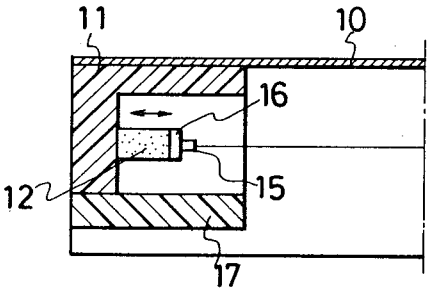
FIGS. 7 through 10 are fragmentary cross-sections showing other different embodiments of the corona discharger concept of the present invention.
Figure 8:
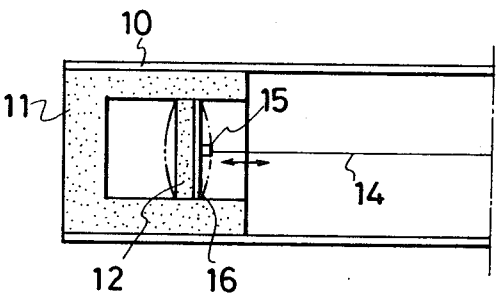

FIGS. 7 and 8 show further embodiments of the present invention in which the supersonic vibrator element 12 is mounted on the insulation support 11 at different locations. In the arrangement shown in FIG. 7, the supersonic vibrator element 12 is vibrated longitudinally. FIG. 8 shows such an arrangement that the supersonic vibrator element 12 extends between the opposite sides of a U-shaped opening in the insulation support 11 and is transversely vibrated to vibrate the corona discharge wire. In both the arrangements, the vibratory direction of the supersonic vibrator element is parallel to the corona discharge wire.

Figure 9:
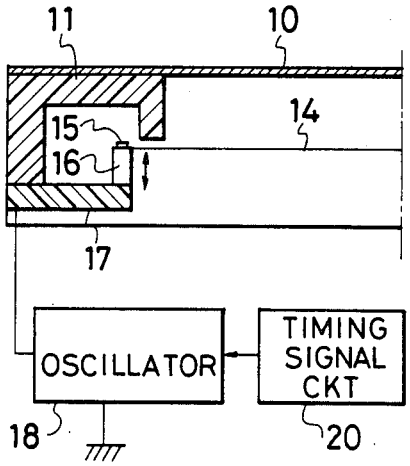
Figure 10:
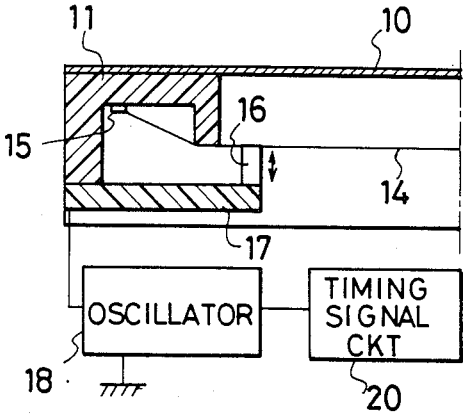

FIGS. 9 and 10 show such arrangements that the cap 17 of the insulation support 11 is utilized as a supersonic vibrator element. In the arrangement of FIG. 9, the corona discharge wire 14 is fixed at one end to the supersonic vibrator element by the anchoring pin 15 through the insulation member 16. When the supersonic vibrator element is actuated, the corona discharge wire is vibrated in the direction of the arrow. In the arrangement of FIG. 10, the vibration of the supersonic vibrator element in the direction of arrow is transmitted to the corona discharge wire 14 through the insulation member 16. In both the arrangements of FIGS. 9 and 10, the opposite end of the corona discharge wire is connected with the connector as in the arrangements of FIGS. 2 and 4.

Figure 16:
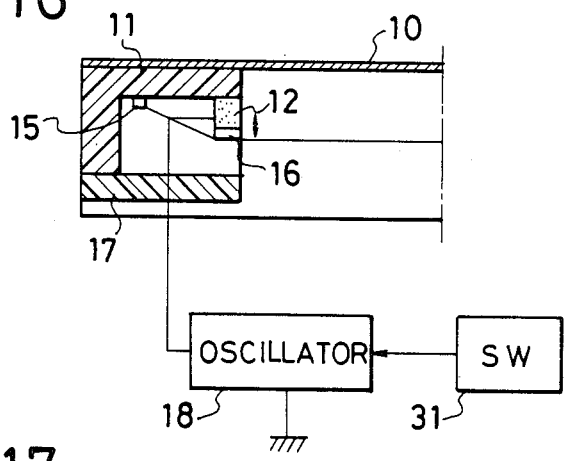
FIGS. 16 and 17 illustrates further embodiments of the present invention each of which functions to control the operation of a supersonic vibrator in the corona discharger according to the present invention.
Figure 17:
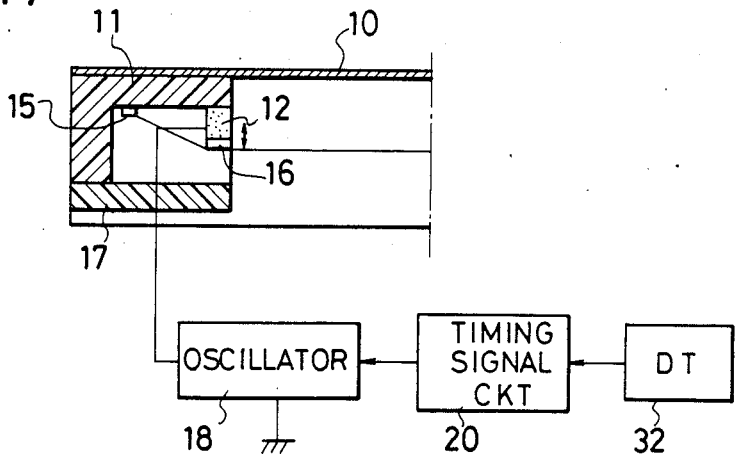

The oscillator circuit 18 can be controlled by manual switch means (SW) 31 located on any suitable position, such as the operation panel, without the use of any timing signal as shown in FIG. 16. As a result, for example, the supersonic vibrator element can be actuated manually at any desired time. When the switch means 31 is manually operated, the oscillator circuit 18 generates a signal which is supplied to actuate the supersonic vibrator element so that the corona discharge wire will be vibrated to shake any foreign matters thereoff. As shown in FIG. 17, further, there may be provided a detector means (DT) 32 for detecting the number of copied sheets or the accumulation of copy time. If the detector means 32 detects a predetermined value, said timing signal circuit 20 is actuated to generate a timing signal which is in turn supplied to actuate the oscillator circuit 18 so that the supersonic vibrator element will be vibrated. The above number of copied sheets or the accumulation of copy time corresponds to the accumulation of time through which the corona discharge wire is energized.

Figure 11:
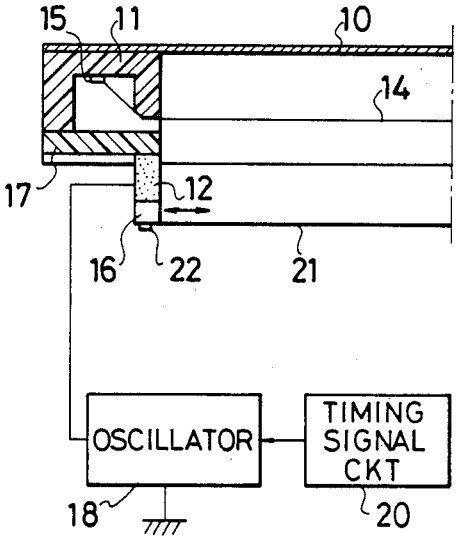
FIGS. 11 and 12 are fragmentary cross-sections showing the corona discharge apparatus according to the present invention when its grid wires are subjected to the action of a supersonic vibrator.
Figure 12:
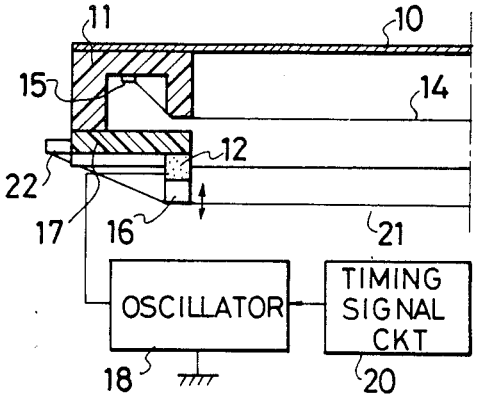

Although the previous embodiments have been described as to the corona discharge wire vibrated by the supersonic vibrator element to shake the foreign matters off the corona discharge wire, the present invention can be applied to grid wires disposed between the corona discharge wire and a surface to be subjected to discharge for controlling the potential thereof. FIGS. 11 and 12 show such arrangements that the supersonic vibrator element acts on the grid wires to shake foreign matters thereoff. In the arrangement of FIG. 11, a plurality of grid wires 21 are spanned outwardly of the corona discharge wire 14, each of the grid wires 21 being mounted at one end on the supersonic vibrator element 12 by an anchoring pin 22 through the insulation member 16. In the arrangement of FIG. 12, each of similar grid wires 21 is mounted at one end on the insulation support 11 by the anchoring pin 22. In the latter case, the vibration of the supersonic vibrator element in the direction of the arrow is transmitted to the grid wires 21 through the insulation member 16. When the supersonic vibrator element is actuated, the grid wires are vibrated to shake the foreign matters thereoff. The oscillator circuit for operating the supersonic vibrator element is controlled in the same manner as in the previous embodiments.

In accordance with the present invention, the supersonic vibrator element can be operated also by the other methods.

Figure 13:
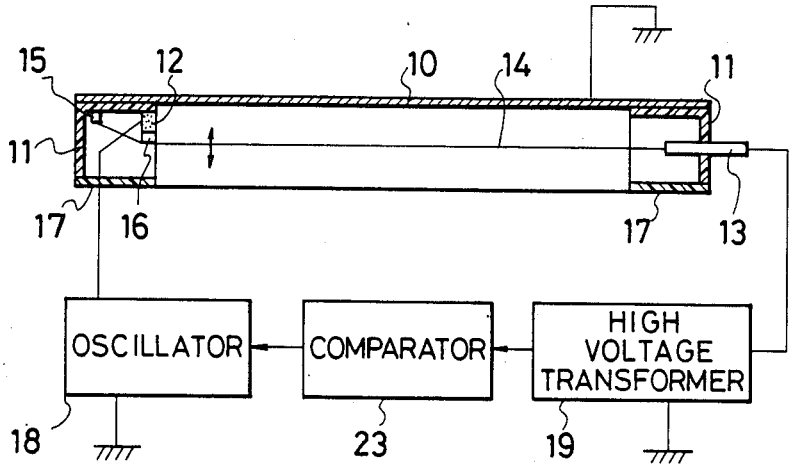
FIGS. 13 through 15 illustrate other embodiments of the present invention each of which is adapted to control the operation of a supersonic vibrator in the corona discharger according to the present invention.

FIG. 13 shows one of the other methods for operating the supersonic vibrator element 12 against which the corona discharge wire 14 is pressed through the insulation member 16. In this figure, the high-voltage transformer 19 is a constant-current transformer. If a great amount of foreign matters are deposited on the corona discharge wire, its efficiency of discharge is reduced so that a voltage to be applied to the corona discharge wire, that is, the output voltage of the high-voltage transformer will be highly increased. On the contrary, if a lesser amount of foreign matters are deposited on the corona discharge wire to create any abnormal discharge, the applied voltage will greatly be decreased. Therefore, a range of voltage so anticipated that the corona discharge wire will not contaminated by the foreign matters deposited thereon is stored in a comparator circuit 23. If a voltage applied to the corona discharge wire is not in the above range of voltage, it is judged that foreign matter is on the corona discharge wire. As a result, the comparator circuit 23 generates an exciting signal which is in turn supplied to the oscillator circuit 18 to operate the supersonic vibrator element 12. The supersonic vibrator element 12 vibrates in the direction of the arrow as shown in FIG. 13, so that the corona discharge wire 14 pressed against the vibrator element through the insulation member 16 is vibrated to shake the foreign matters thereoff. Even if the satisfactory discharge is not restored by the above vibration of the corona discharge wire, a mechanism for warning of the abnormal state may be actuated such that the desired discharge can be restored by manually cleaning the corona discharge wire.

Figure 14:
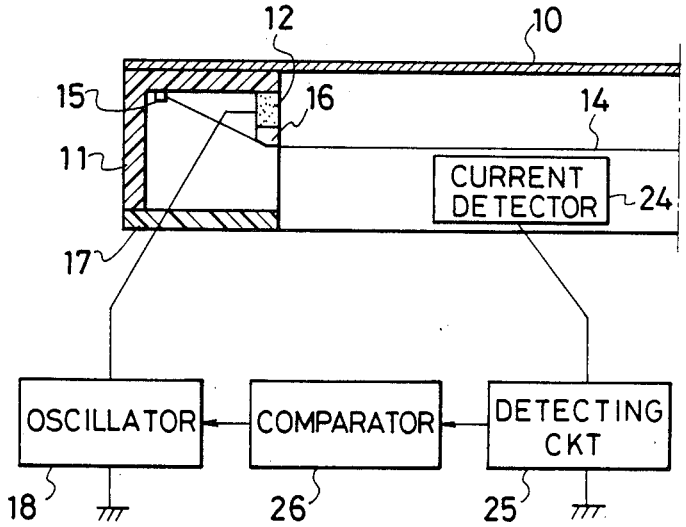

FIG. 14 shows such an arrangement in which the current flowing from the corona discharge wire 14 to the shield plate 10 is detected to control the operation of the supersonic vibrator element. Part of the shield plate 10 is provided with a current detecting section 24 insulated therefrom. This current detecting section 24 is monitored by a detection circuit 25 with respect to the current detected by the current detecting section 24. The output of the detection circuit 25 is supplied to a comparator circuit 26 whereat the detected current is compared with a preset value in the comparator circuit 26. If a large difference between the output of the detection circuit 25 and said preset value is detected, any contamination of the corona discharge wire is judged so that a signal for operating the supersonic vibrator element will be supplied from the comparator circuit 26 to the oscillator circuit 18.

Figure 15:
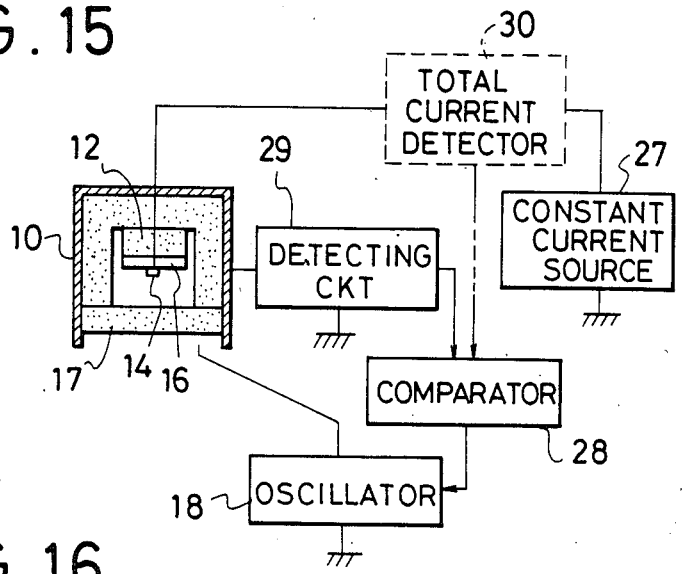

FIG. 15 shows such an arrangement in which a comparator circuit 28 in which the total current of a constant-current source of electric power 27 is stored receives the output of a shield current detecting circuit 29 for detecting the current flowing through the shield plate 10. At the comparator circuit 28, the total current of the constant-current source 27 is compared with the output of the shield current detecting circuit 29 to know a difference therebetween, that is, the current flowing toward a surface to which the discharge is applied. In accordance with the magnitude of this differential current, the comparator circuit 28 operates the oscillator circuit 18. However, a total-current detecting curcuit 30 may be provided as shown by the broken line without the pre-storing of the total current in the comparator circuit 28. In this case, the comparator circuit 28 compares a value detected by the total-current detecting circuit 30 with a value detected by the above shield current detecting circuit 29.

Thus, each of the embodiments shown in FIGS. 13, 14 and 15 can operate the supersonic vibrator element by comparing a current required to effect a corona discharge with a preset value so that any foreign matter deposited on the corona discharge wire will always be detected. In accordance with the amount of deposited foreign matter, the corona discharge wire is vibrated by the supersonic vibrator element to shake the foreign matter off the corona discharge wire.

As is apparent from the foregoing, the present invention provides vibrating means for vibrating the corona discharge electrode and/or grid electrodes to shake the foreign matters thereoff. Therefore, the deposition of the foreign matters can be extremely reduced to maintain the stable or uniform discharge for a prolonged period of time. Furthermore, the burning of the foreign matter into the corona discharge electrode and/or grid electrodes due to heat produced upon discharge can be reduced so that the corona discharge wire is improved in service life to increase the durability of the corona discharger itself.

What we claim is:

1. A corona discharging apparatus comprising:

a corona discharge electrode;

shield means surrounding said corona discharge electrode, said shield means including an opening for permitting at least corona discharge current to pass therethrough;

support means for supporting said corona discharge electrode;

supersonic vibrator means for vibrating said corona discharge electrode to remove foreign matter from said corona discharge electrode; and drive means for applying a drive voltage to said supersonic vibrator means, a constant-current source of high voltage for applying a high voltage to said corona discharge electrode, and comparator means for comparing a voltage applied to said corona discharge electrode with a predetermined range of voltage, said drive means being adapted to operate if the voltage applied to said corona discharge electrode is out of said predetermined range of voltage.

2. A corona discharging apparatus comprising:

a corona discharge electrode;

shield means surrounding said corona discharge electrode, said shield means including an opening for permitting at least corona discharge current to pass therethrough;

support means for supporting said corona discharge electrode;

supersonic vibrator means for vibrating said corona discharge electrode to remove foreign matter from said corona discharge electrode; and drive means for applying a drive voltage to said supersonic vibrator means, detector means for detecting current flowing through said shield means, and a comparator circuit for comparing the detection output of said detector means with a preset value, said drive mans being adapted to operate if at least a predetermined difference is detected between the detection output of said detector means and said preset value.

3. A corona discharging apparatus comprising:

a corona discharge electrode;

shield means surrounding said corona discharge electrode, said shield means including an opening for permitting at least corona discharge current to pass therethrough;

support means for spanning said corona discharge electrode;

supersonic vibrator means for vibrating said corona discharge electrode to remove foreign matter from said corona discharge electrode; and drive means for applying a drive voltage to said supersonic vibrator means, a first detector means for detecting current flowing through said shield means, a second detector means for detecting the total current from a constant-current source of electric power, and a comparator circuit for comparing a value detected by said first detector means with a value detected by said second detector means to determine a difference therebetween, said drive means being adapted to operate in accordance with the magnitude of said difference.

4. A corona discharging device used for an electrophotographic copying apparatus comprising:

a corona discharge electrode;

shield means surrounding said corona discharge electrode, said shield means including an opening for permitting at least corona discharge current to pass therethrough;

support means for supporting said corona discharge electrode;

supersonic vibrator means for vibrating said corona discharge electrode to remove foreign matter from said corona discharge electrode;

drive means for driving said supersonic vibrator means;

high-voltage source means for applying a high-voltage to said corona discharge electrode; and timing signal generating means for applying a timing signal to said drive means for actuating said supersonic vibrator means at a time other than during a copying operation.

5. A corona discharging device according to claim 4, wherein said timing signal generating means applies a timing signal to said drive means for actuating said supersonic vibrator means when said high-voltage source means is in the off state.

6. A corona discharging device according to claim 4, wherein said device further comprises detection means for detecting the accumulation of the number of copying operations, and for causing said timing signal generating means to apply said timing signal to said drive means for actuating said supersonic vibrator means when the detected number of copying operations reaches a predetermined value.

7. A corona discharging device according to claim 4, 5 or 6, wherein said corona discharge electrode is fixed to said supersonic vibrator means.

8. A corona discharging device according to claim 4, 5 or 6, wherein said corona discharge electrode is supported on said support means in such a state that said corona discharge electrode is pressed against said supersonic vibrator means.

9. A corona discharging device used for an electrophotographic copying apparatus comprising:

a corona discharge electrode;

shield means surrounding said corona discharging electrode, said shield means including an opening for permitting at least corona discharge current to pass therethrough;

support means for supporting said corona discharge electrode;

grid electrodes disposed between said corona discharge electrode and a surface to which a corona discharge is applied;

supersonic vibrator means for vibrating said grid electrodes to remove foreign matter from said grid electrodes;

drive means for driving said supersonic vibrator means;

high-voltage source means for applying a high voltage to said corona discharge electrode; and timing signal generating means for applying a timing signal to said drive means for actuating said supersonic vibrator means at a time other than during a copying operation.

10. A corona discharging device according to claim 9, wherein said timing signal generating means applies a timing signal to said drive means for actuating said supersonic vibrator means when said high-voltage source means is in the off state.

11. A corona discharging means according to claim 9, wherein said, device further comprises detection means for detecting the accumulation of the number of copying operations, and for causing said timing signal generating means to apply a timing signal to said drive means for actuating said supersonic vibrator means when the detected number of copying operations reaches a predetermined value.

12. A corona discharging means according to claim 9, 10 or 11, wherein said grid electrodes are fixed to said supersonic vibrator means.

13. A corona discharging means according to claim 9, 10 or 11, wherein said grid electrodes are supported in such a state that they are pressed against said supersonic vibrator means.

* * * * *

UNITED STATES PATENT AND TRADEMARK OFFICE

CERTIFICATE OF CORRECTION

PATENT NO. : 4,680,669

DATED : July 14, 1987

INVENTOR(S) : HIROAKI TSUCHIYA, ET AL.

It is certified that error appears in the above-identified patent and that said Letters Patent is hereby corrected as shown below:

COLUMN 1

Line 25, "matters" should read --matter--.

COLUMN 3

Line 59, "matters" should read --matter--.

COLUMN 4

Line 11, "vibrator the vibrate" should read --the vibrator to vibrate the--.
Line 13, "matters" should read --matter--.
Line 22, "matters" should read --matter--.
Line 65, "matters" should read --matter--.

COLUMN 5

Line 11, "matters" should read --matter--.
Line 30, "matters" should read --matter--.
Line 42, "matters are" should read --matter is--.
Line 47, "matters are" should read --matter is--.
Line 51, "not" should read --not be--.
Line 52, "matters" should read --matter--.
Line 63, "matters" should read --matter--.

COLUMN 6

Line 50, "matters" should read --matter--.
Line 51, "matters" should read --matter--.
Line 52, "the" should be deleted.

UNITED STATES PATENT AND TRADEMARK OFFICE

CERTIFICATE OF CORRECTION

PATENT NO. : 4,680,669

DATED : July 14, 1987

INVENTOR(S) : HIROAKI TSUCHIYA, ET AL.

It is certified that error appears in the above-identified patent and that said Letters Patent is hereby corrected as shown below:

COLUMN 7

Line 29, "mans" should read --means--.

COLUMN 8

Line 54, "said, device" should read --said device--.

Signed and Sealed this

Ninth Day of February, 1988

*Attest:*

DONALD J. QUIGG

*Attesting Officer*

*Commissioner of Patents and Trademarks*